US008894783B2

(12) United States Patent
Dixon et al.

(10) Patent No.: US 8,894,783 B2
(45) Date of Patent: Nov. 25, 2014

(54) METAL AUGMENTED CHARGE

(75) Inventors: George P. Dixon, Ridgecrest, CA (US); Eddie R. Celestine, Ridgecrest, CA (US); Will Carey, Jr., Ridgecrest, CA (US); Henry J. John, Jr., Jacksonville, AR (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 3798 days.

(21) Appl. No.: 10/405,802

(22) Filed: Mar. 7, 2003

(65) Prior Publication Data

US 2014/0182473 A1 Jul. 3, 2014

(51) Int. Cl.

| | |
|---|---|
| ***C06B 45/10*** | (2006.01) |
| ***F42B 12/46*** | (2006.01) |
| ***C06B 27/00*** | (2006.01) |
| ***F42B 12/52*** | (2006.01) |
| ***F42B 35/00*** | (2006.01) |

(52) U.S. Cl.

CPC ..... *C06B 27/00* (2013.01); *F42B 12/52* (2013.01); *F42B 35/00* (2013.01)

USPC ..... 149/19.3; 102/363

(58) Field of Classification Search

CPC ..... C06B 45/10; F42B 12/46

USPC ..... 149/19.3, 37; 102/363

See application file for complete search history.

(56) References Cited

U.S. PATENT DOCUMENTS

| | | | | | |
|---|---|---|---|---|---|
| 3,203,171 | A | * | 8/1965 | Burke, Jr. et al. | 60/211 |
| 3,730,093 | A | * | 5/1973 | Cummings | 102/363 |
| 4,463,680 | A | * | 8/1984 | Sayles | 102/363 |
| 5,168,123 | A | * | 12/1992 | Lee | 102/363 |
| 5,852,256 | A | * | 12/1998 | Hornig | 102/473 |

* cited by examiner

*Primary Examiner* — Aileen B Felton

(74) *Attorney, Agent, or Firm* — Anthony Serventi; Earl Baugher; Laura Foster

(57) ABSTRACT

This invention relates to an apparatus for explosively dispersing particles of reactive metals into the atmosphere to form a fuel-air explosive. Also, this invention relates to a composition, which enhances the performance of metal augmented charge (MAC) devices. The metal augmented charge (MAC) includes flaked aluminum powder and polytetrafluorethylene. The MAC is pressed into solid billets. A preferred embodiment of the present invention involves a system with heavy-walled warhead, which comprises a canister and a cylinder of MAC disposed in the canister, so that said cylinder is in contact with the interior wall of the canister. Further, a high explosive is disposed in the cylinder with a fuze in direct contact with the high explosive, in such a way that the fuze detonates the high explosive.

9 Claims, 4 Drawing Sheets

METAL AUGMENTED CHARGE

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefore.

BACKGROUND OF THE INVENTION

1. Field of the Invention

This invention relates to an apparatus for explosively dispersing particles of combustible metals into the atmosphere to form a fuel-air explosive. Also, this invention relates to a composition, which enhances the performance of metal augmented charge (MAC) devices.

2. Description of the Related Art

A conventional fuel-air explosive (FAE) device event consists of two stages. In the first stage, the liquid fuel is explosively dispersed to form a large fuel-air cloud. In stage two, a high explosive secondary charge is detonated to generate a shock wave, which initiates detonation of the dispersed medium.

These explosives comprise an air combustible hydrocarbon, such as propane, butane, ethylene oxide, gasoline, or the like, disposed in a suitable tank surrounding a central charge of high explosive. Detonation of this high explosive disperses the hydrocarbon throughout the environment. After a delay, which permits the formation of a vapor cloud, the fuel-air mixture is usually ignited by means of a secondary delayed charge.

While this type of explosive may be thought of as deriving a significant part of its energy from the environment, being based on the use of totally different materials, namely liquid hydrocarbons, there are significant limitations in the handling and application of such munitions. These relate to problems stemming from the use of liquids in tanks, which present special hazards relating to leakage, especially upon penetration, and generally the poor strength of tank structure. The explosive devices based on the present metallic reactive materials not only avoid such problems, but also offer many additional desirable features and capabilities, as discussed in detail below.

The mechanism of the MAC device includes an explosive dispersion charge in the charge system to disperse the fuel into the surrounding atmosphere. The primary detonation in this manner forms a cloud of atomized fuel and generates a strong primary air shock. The available atmospheric oxygen mixed with the cloud reacts instantly with the detonation products and generates the fuel-air explosive effect.

In recent years, single event FAE's have been developed. Single event FAE's disperse the fuel into a large cloud that detonates after a prescribed delay time. One version of an FAE is the turbulent jetting of a compatible chemical initiator, such as fluorine gas, into a dispersed cloud of fuel, such as hydrogen, creating a chemical reaction that results in self-detonation of the fuel cloud, as described in U.S. Pat. No. 5,168,123 issued to Lee on Dec. 1, 1992.

The metal liner of shaped charges is basically the source material for forming a hot metallic jet of immense penetration capability. The concave configuration of the explosive charge and the liner are both conducive to forming this hot metal jet. The mechanism of jet formation is basically a hydrodynamic phenomenon, operative in the liner material in bulk form. Self-forming-fragment (SFF) munitions are similar to shaped charge explosives, in the sense that the metal liner forms a mass of hot metal which is propelled in the direction of a target by the explosive charge, however with a lesser degree of jet formation. Nevertheless, as in the case of conventional shaped charges, the metal forms a relatively cohesive body of hot material propelled away from the point of detonation toward a target, but largely together, as a glob of material. Although these shaped charge type explosive devices may employ reactive metals, they do not derive a meaningful amount of energy from the interaction of the reactive metal with the environment, because the metal moves as a cohesive mass of material. While the degree of interaction with the environment may be greater for reactive metal of SFF type explosive devices, the directionality and concentration of the metal ejected from the explosive limits the amount of energy derived from any metal-air reaction.

By contrast, the present explosive propels and disperses combustible metal over a relatively large space surrounding the point of detonation in relatively finely divided form in order to enhance the metal surface area exposed to and reacting with the medium.

U.S. Pat. No. 5,852,256 issued to Hornig on Dec. 22, 1998 discloses a non-nuclear, non-focusing, active warhead that comprises a high explosive (HE) charge contained within a casing of reactive metal. In the '256 patent, a reactive metal reacts rapidly with the medium, such as air, in which the explosion takes place, or with a material which surrounds or is part of the target. However, the '256 patent describes this principle very broadly and does not provide formulations for the reactive metal. Further, the present invention provides formulations for a MAC that may be used in a similar manner, but with superior results to the '256 patent. The present invention uses flaked aluminum powder of specific sizes.

SUMMARY OF THE INVENTION

Reduction in the energetic payload capacities of warheads requires the use of novel explosive fills to enhance lethality and damage mechanisms against compartmented or confined targets. This invention involves a MAC fill that can provide a substantial increase in performance over a conventional high explosive (HE) fill of equivalent volume.

One object of a preferred embodiment of the present invention is to provide a MAC with improved performance per same mass.

Another object of a preferred embodiment of the present invention is to provide a MAC with approximately 930% energy of detonating TNT using an equal volume basis.

Another object of a preferred embodiment of the present invention is to provide a MAC with greater density, which creates a greater performance per same volume.

Another object of a preferred embodiment of the present invention is to provide an improved MAC, which may be produced from commercially available components.

Another object of a preferred embodiment of the present invention is to provide an improved MAC with normal storage requirements and a long shelf life.

Another object of a preferred embodiment of the present invention is to provide an improved MAC with low toxicity and which is easily disassembled and recycled into non-toxic and reusable raw material.

Another object of a preferred embodiment of the present invention is to provide an improved MAC, which is easy and safe to process and handle in the field.

Another object of a preferred embodiment of the present invention is to provide an improved MAC with a lower cost when compared to a conventional MAC.

A still further object of a preferred embodiment of the present invention is to provide an improved MAC, which is easy to process using existing equipment.

Upon detonation, the high explosive disperses the reactive metal in the form of relatively fine particles throughout the space in which detonation occurs. This causes the reactive metal to violently and exothermally interact with the environment and multiply the explosive yield of the device. The MAC comprises about 85 to 90% flaked aluminum powder having an average size of about 12 microns to about 14 microns and about 8 to 15% polytetrafluorethylene. The MAC is pressed into solid billets having a density of about 1.7 gm/cm$^3$ to about 2.3 gm/cm$^3$.

A preferred embodiment of the present invention involves a system with a heavy-walled warhead, which comprises a canister and a cylinder of MAC disposed in the canister, so that said cylinder is in contact with the interior wall of the canister. Further, a high explosive is disposed in the cylinder with a fuze in direct contact with the high explosive, in such a way that the fuze detonates the high explosive. In a more preferred embodiment, the MAC of the heavy-walled warhead is pressed into solid billets comprising a density of about 1.7 gm/cm$^3$ to about 2.3 gm/cm$^3$ and the MAC comprises about 90% flaked aluminum powder and about 10% polytetrafluorethylene.

These and other objects of the invention will become more clear when one reads the following specification, taken together with the drawings that are attached hereto. The scope of protection sought by the inventors may be gleaned from a fair reading of the Claims that conclude this specification.

DETAILED DESCRIPTION OF THE INVENTION

Figure 1:
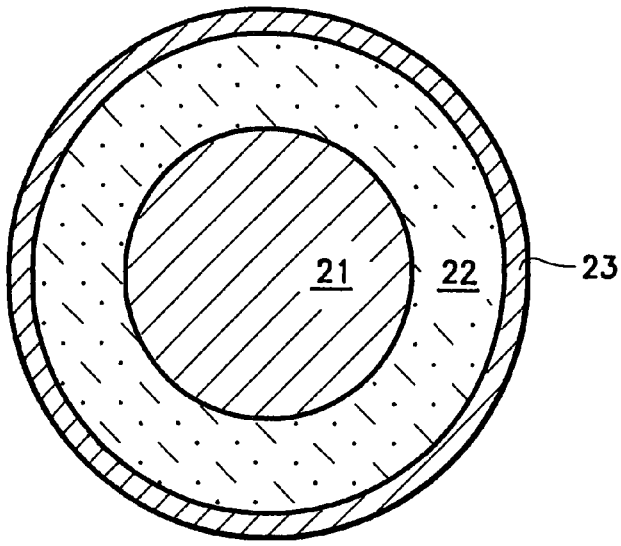
FIG. 1 is a cross sectional schematic view of a preferred embodiment of the present invention.
Figure 2:
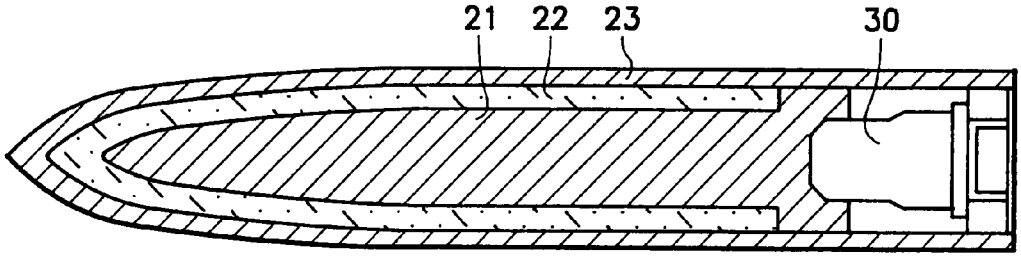
FIG. 2 is an illustration of a preferred embodiment of the present invention as used in a penetration type warhead.

Referring more specifically to the drawings, for illustrative purposes the present invention is embodied in the apparatus as shown in FIGS. 1 and 2. It will be appreciated that the apparatus may vary as to configuration and as to details of the parts without departing from the basic concepts as disclosed herein.

As a matter of preference, the shapes of the high explosive charge are preferably spherical or cylindrically symmetric, as illustrated in FIG. 1, to provide a uniform dispersion pattern. The reactive material component of casing 23 is in general any material that is relatively easy to oxidize, more particularly in the context of the present explosive, the Group 1A, 2A, 3A, 3B metals, including the lanthanides and actinides, as well as Group 4B metals, may be considered reactive materials. In addition, their intermetallic alloys and compounds, their hydrides, silicides, phosphides, and carbides may provide suitable reactive materials. Specific preferred materials are magnesium, aluminum, titanium, zirconium, or cerium metal; intermetallic alloys thereof; or unstable compounds containing metals such as suicides and phosphides. $LiBH_4$, TiH, LiH, and LiAlH have been found to provide especially effective materials for use in casings. Depending on the type of metal used and the configuration of the casing, the amount of reactive metal may be up to 400% of the weight of the high explosive. FIG. 1 shows the relative locations of MAC 22 and high explosive 21 from an end-on perspective.

Referring to FIG. 2, solid metal casings are typically machined from stock, but can also be manufactured by other methods such as casting or forging. Detonation of the HE tends to form relatively small fragments. However, it is preferred to insure that small fragments are produced by such measures as prescoring, as well as other methods known in the fragmentation munition art, which will tend to result in copious production of small fragments. It should be kept in mind that the primary intent is to produce relatively small metal particles in order to expose as large a surface area as possible to the environment to produce energy and blast. However, for certain targets it may be desirable to produce a limited number of larger fragments.

Particularly effective casing structures are made of reactive material powders disposed in a matrix of polymeric binder materials, rather than from solid metals. Such casing structures offer flexibility in the choice of reactive metal particle sizes incorporated in the matrix. For example, should it be desirable to produce an explosive device which will produce a certain fraction of larger reactive material fragments, an appropriate proportion of such fragments would be incorporated in the casing during manufacture.

It is to be noted that, unlike the prior art, the present active warhead spreads the metal particles out over a symmetrical area after the explosion. Stated another way, the pattern of dispersal is not focused, but uniform in distribution, in order to maximize the interaction between the metal and the environment. It is this feature which maximizes blast effects. Another benefit is that effectiveness against targets is also improved due to better hit and destruction probabilities.

The environment of the detonation is normally defined as air. In principal, however, the environment could be water or any other material, which is abundant in the intended target environment. The combustible metal component is chosen according to its reactivity with respect to this environmental component, and reacts chemically with the reactive material. For example, for an explosive device for submarine applications, casings comprising alkali or alkaline earth metals or compounds reacting vigorously with water could be employed.

The present explosive device may be detonated by means of time, proximity, or impact fuzes located in the fuze assembly 30, illustrated in FIG. 2, in the same manner as conventional blast explosives. The MAC of a preferred embodiment of the present invention is not a stoichiometric balance of fuel and oxidizer. In other words, the MAC of the current invention is intentionally deficient of oxidizer. In any event, the mechanism is the same: the major part of the explosive energy is derived from the reaction of the material with the medium in which the explosion takes place, rather than from the high explosive, per se. The large savings on device size are due to the fact that the necessary oxidizer need not be carried by the explosive device, but is drawn from the environment. As a result, the explosive energy yield of the present explosive may be up to about 1.5 to 1.7 times as great as the yield from conventional explosives of the same size.

In comparison with the prior art warheads, the present inventive non-focusing active warhead results in a relatively high blast, as pointed out previously, which makes the warhead especially suitable for use against targets sensitive to blast, such as aircraft, light building structures, vehicles, personnel, and the like. However, the substitution of a reactive metal casing for the conventional higher strength steel casings reduces its penetration capability into stronger targets. The present explosive may, however, also be modified for use against hard structures.

FIG. 2 shows a projectile, outfitted with the present non-focusing active warhead, modified for use against hardened targets such as ships, buildings, and the like, which need to be penetrated by the projectile to achieve the desired destructive effects. To facilitate penetration, the warhead is enclosed in hardened steel casing 23, which protects the munition during impact. Casing 23 is made from conventional materials and by conventional methods well known in the art.

The MAC concept consists of a right-circular cylinder of MAC 22 fuel placed inside, and in direct contact with, the inside surface of the casing 23 of the warhead. The core of the high explosive 21 is placed in the center of the cylinder of the MAC 22 fuel, as illustrated in FIGS. 1 and 2. The explosive fill continues past the top of the MAC 22 fuel forming the fuse well, which is in direct contact with the fuze assembly 30. This configuration of the MAC concept is a single event type of a fuel-air explosive (FAE) device and does not require a secondary initiation device as used in the liquid FAE device. Reaction of the MAC fuel is achieved through heat generated during compression and shear of the fuel with the reaction increasing as the fuel reaches oxygen in the surrounding atmosphere during failure of the warhead. The MAC consists of aluminum powder coated with polytetrafluorethylene. The MAC fuel continues to react as it is dispersed from the failing warhead in an expanding and continuing reacting cloud. The longer duration of the MAC reaction, as compared to the duration of a conventional explosive, allows the MAC to build up pressure over a longer period of time resulting in higher impulses and greater damage to structures, particularly when the reacting MAC cloud is confined within the structure.

The MAC fuel is a commercially available flake aluminum powder which has an average size of about 12 microns to about 14 microns thick that is coated with polytetrafluorethylene resulting in a non-stoichiometric powdered fuel with an average of about 85% to about 90% aluminum and about 8% to about 12% polytetrafluorethylene by weight. In a preferred embodiment of the present invention, the MAC contains about 90% of flaked aluminum powder and about 10% of polytetrafluorethylene. The powdered fuel is then pressed into solid billets with an average density of 2.2 gm/cm$^3$ that are machined to the final size and shape. The density of the MAC billets must be maintained between about 1.7 gm/cm$^3$ and about 2.3 gm/cm$^3$ to provide sufficient porosity for the generation of heat to initiate the reaction. The MAC billets are then placed in the warhead and the explosive is cast or pressed into place. The final MAC fuel to explosive ratio is dependent upon the size and configuration of the warhead. In a preferred embodiment the ratio of MAC fuel to high explosive is from about 0.5 to about 1.8. The non-stoichiometric mixture of aluminum to polytetrafluorethylene increases the duration of the MAC reaction and meets the classic definition of a FAE device wherein the reaction of the fuel is dependent upon available oxygen and not the oxidizer in the fuel itself.

Testing

Figure 5:
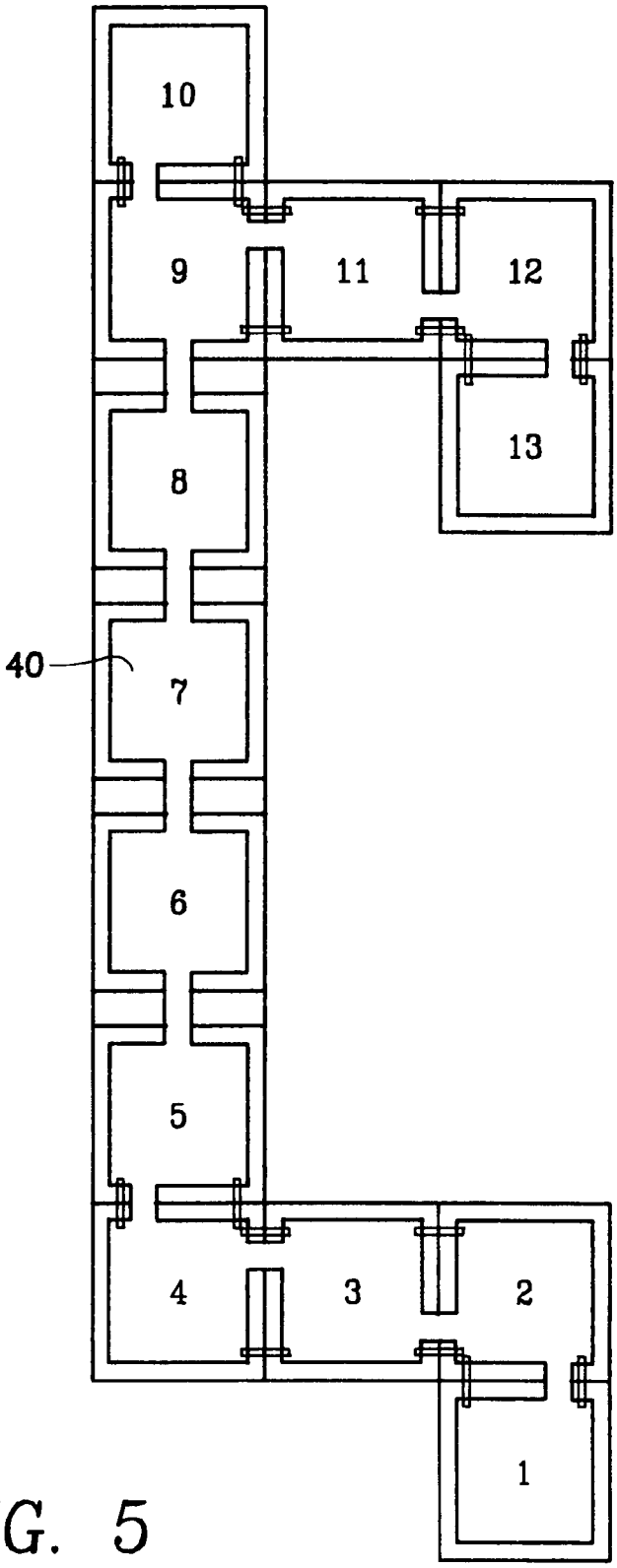
FIG. 5 is a plan view of the facility used to determine to enhanced blast characteristics of a preferred embodiment of the present invention.

FIG. 5 is a plan view of an existing multi-room shallow buried structure used for the testing of the metal augmented charge (MAC). Individual room dimensions were 5 ft by 5 ft by 5 ft. Doorways connecting the rooms were nominally 1.5 ft wide and 3.5 ft tall. Rooms are numbered from 1 to 13, with both Rooms 1 and 13 having removable steel lids to vent detonation products after each test. Access to the other rooms is achievable only through access Rooms 1 and 13. The reinforced concrete walls of the structure are nominally at least 4 in thick, and Rooms 2-12 had non-removable reinforced concrete roofs. The intent was to provide an interior multi-room chamber where the volume would not change because of roof failure under a significant quasi-static pressure environment of up to about 10 psi. The steel lids put in place just prior to each test for Rooms 1 and 13 are not tied down, and thus serve to limit the pressures generated within the structure as a whole, and eventually their upward motion vents the gas pressures generated inside the structure by the test. Three-inch diameter vents to the surface were also installed in Rooms 2, 7, 10 and 12. These could be either open or closed for a particular test, but typically at least two are left open to provide for long-term structure venting. In addition, the walls of the source chamber 40, were lined with steel plate to mitigate the damage caused by multiple testing of fragmenting cased weapons. The test device is placed inside the source chamber 40. Since the devices are always placed in the source chamber 40, the explosive detonation products and reactive materials must proceed out of the source chamber principally through the two doorways into the two adjoining rooms, with some gasses also expected to vent out through the source chamber's vent pipe. Instrumentation ports are included in each room.

Two tests were conducted using the 13-room structure. The same steel casings were used for both tests. On Test #1, a cylinder was filled with a baseline HE fill, PBXN-109. The total explosive weight was 0.339 kg (0.748 lb). For Test #2, the steel casing was filled with a MAC source. An annular region of MAC fuel surrounded a center column of PBXN-112 (previous designation PBXC-129) explosive. The total HE weight was 0.112 kg (0.247 lb) and the total MAC fill weight was 0.294 kg (0.648 lb). Therefore, the MAC to HE ratio for this particular test was 2.62 to 1 for the device tested in Test #2.

Figure 3:
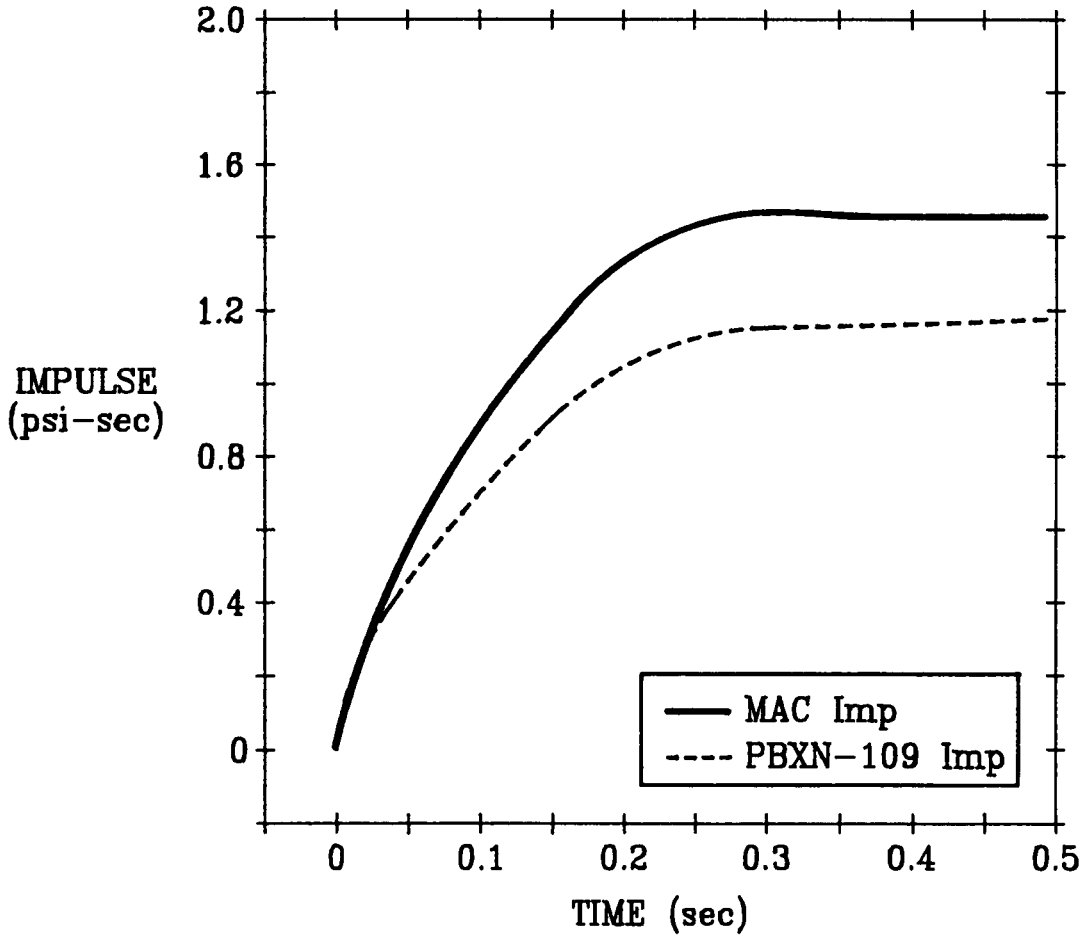
FIG. 3 is a graphical illustration of a preferred embodiment of the present invention, which details the desirable enhanced blast characteristics.
Figure 4:
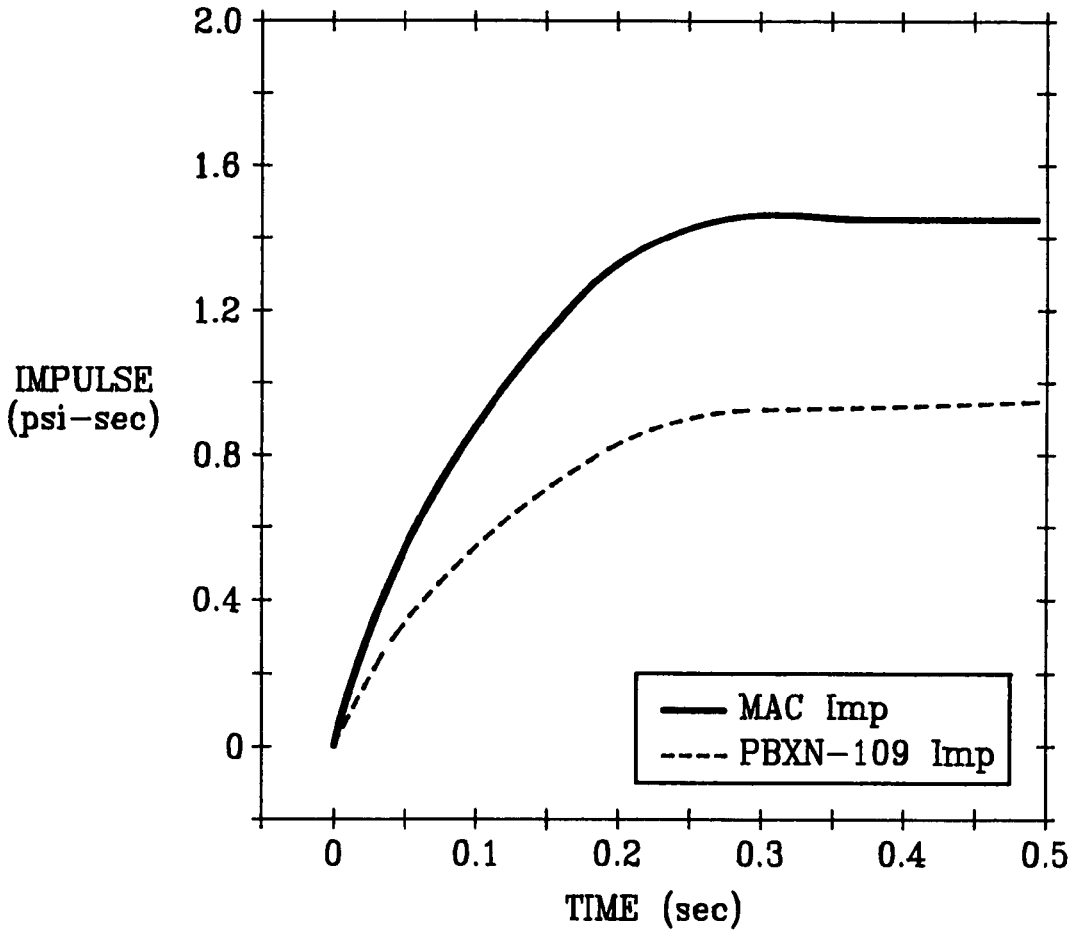
FIG. 4 is a graphical illustration of a preferred embodiment of the present invention, which details the desirable enhanced blast characteristics.

Referring to FIGS. 3 and 4, a preferred embodiment of the present invention was proved to be superior to MAC's currently in the art. The MAC source of the current invention produced 29% higher impulses in the source chamber and approximately 42% higher impulse than the PBXN-109 explosive outside the source chamber. Overall the MAC of the current invention produced an average of 1.9 times higher overtemperature than the PBXN-109 tested.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A metal augmented charge (MAC) comprising:

about 85 to 90% flaked aluminum powder having an average size of about 12 microns to about 14 microns; and about 8 to about 12% polytetrafluorethylene;

wherein said MAC is pressed into a cylindrical casing.

2. The MAC of claim 1, wherein said MAC is pressed into solid billets comprising a density of about 1.7 gm/cm$^3$ to about 2.3 gm/cm$^3$.

3. The MAC of claim 1 wherein said MAC comprises:

90% flaked aluminum powder having an average size of about 12 microns to 14 microns; and 10% polytetrafluorethylene.

4. A heavy-walled warhead which comprises:

a canister;

a metal augmented charge (MAC) comprising:

about 85 to 90% flaked aluminum powder having an average size of about 14 microns and about to 8 to 12% polytetrafluorethylene;

a cylinder of said MAC disposed in said canister, so that said cylinder is in contact with the interior wall of said canister;

a high explosive disposed in said cylinder; and a fuze in direct contact with said high explosive, wherein said fuze detonates said high explosive.

5. The heavy-walled warhead of claim 4, wherein said MAC is pressed into solid billets comprising a density of about 1.7 $gm/cm^3$ to about 2.3 $gm/cm^3$.

6. The heavy-walled warhead of claim 4 wherein said MAC comprises:

about 90% flaked aluminum powder; and about 10% polytetrafluorethylene.

7. The heavy-walled warhead of claim 4, wherein said canister is constructed of a metal selected from the group consisting of common steels.

8. The heavy-walled warhead of claim 4, wherein said high explosive is selected from the group consisting of PBXN-112 explosive.

9. The heavy-walled warhead of claim 4, wherein the ratio of said MAC to said high explosive is from about 0.5 to about 1.8.

* * * * *